US006433290B1

(12) United States Patent
Ulerich et al.

(10) Patent No.: US 6,433,290 B1
(45) Date of Patent: Aug. 13, 2002

(54) TRIP INDICATOR INCLUDING LATCH FOR A CIRCUIT BREAKER

(75) Inventors: Phillip Lloyd Ulerich; James Jeffery Benke, both of Pittsburgh; Thomas Lee Aber, Verona; Ronald Paul Silich, Coraopolis, all of PA (US)

(73) Assignee: Eaton Corporation, Cleveland, OH (US)

( * ) Notice: Subject to any disclaimer, the term of this patent is extended or adjusted under 35 U.S.C. 154(b) by 37 days.

(21) Appl. No.: 09/758,887

(22) Filed: Jan. 11, 2001

(51) Int. Cl.[7] ..... H01H 9/00
(52) U.S. Cl. ..... 200/308; 200/318
(58) Field of Search ..... 210/50.01, 552, 210/308, 318, 327

(56) References Cited

U.S. PATENT DOCUMENTS 5,886,641 A 3/1999 Ulerich et al. ..... 340/638

*Primary Examiner*—J. R. Scott
(74) *Attorney, Agent, or Firm*—Martin J. Moran

(57) ABSTRACT

An indicator apparatus for a circuit breaker includes an indication mechanism and a latch mechanism mounted on a base, the base being mounted within the circuit breaker. The indication mechanism includes an indicator movably mounted on the base and being translatable along a longitudinal axis between a retracted position and an extended position, with the indicator in the extended position providing an indication visible from the exterior of the circuit breaker of a tripped condition of the circuit breaker. The latch mechanism includes a latch that is pivotable between a blocking position and a release position, with the latch in the blocking position being engageable with a ledge on the indicator to retain the indicator in the retracted position. The indicator is biased to the extended position by a first biasing device, and the latch is biased to the blocking position by a second biasing device. The abstract shall not be used for interpreting the scope of the claims.

20 Claims, 6 Drawing Sheets

TRIP INDICATOR INCLUDING LATCH FOR A CIRCUIT BREAKER

BACKGROUND OF THE INVENTION

1. Field of the Invention

The present invention relates generally to circuit breakers, and more particularly, to a circuit breaker having a trip indicator for providing a visual indication of the trip status of the circuit breaker.

2. Description of the Related Art

Circuit breakers of the type having an electrically insulated housing, separable electrical contacts movable between closed and open positions, an operating mechanism for moving the electrical contacts between the closed and open positions, and a tripping mechanism operatively connected with the operating mechanism are generally known in the relevant art. Typically, the tripping mechanism senses an electrical condition, such as an overcurrent condition or an under-voltage condition, and actuates the operating mechanism in order to move the separable electrical contacts from the closed position to interrupt the flow of current therethrough. Inasmuch as the separable electrical contacts, operating mechanism, and tripping mechanism are typically disposed within the housing of the circuit breaker, such components typically cannot be visually inspected to determine the trip status of the circuit breaker and ascertain whether or not a tripping operation has occurred. Many circuit breakers thus are equipped with a device for indicating, either locally or at a remote location, the trip status of the circuit breaker. Such devices may take the form of mechanical and/or electrical indicators.

The trip indicator assembly disclosed generally in U.S. Pat. No. 5,886,641 to Ulerich et al. provides both mechanical and electrical indicators to indicate the trip status of a circuit breaker. The mechanical indicator thereof is in the form of an indicator end or "button" that protrudes through a hole in a cover of a circuit breaker when the circuit breaker is in a tripped condition. The electrical indicator is provided by one or more microswitches electrically connected with bell alarms and the like, with the microswitches being operated by the same mechanical indicator that causes the "button" to protrude from the circuit breaker cover when the circuit breaker is in the tripped condition. While the trip indicator assembly disclosed in the aforementioned patent is useful for its intended purposes, it is not, however, without limitation.

For instance, during normal operation of the circuit breaker, the button is disposed within the hole of the cover (though not protruding therefrom) and thus is subject to being vibrated by the cover during shock loading of the circuit breaker. Such vibration can have the effect of inappropriately releasing the spring-loaded button from its catch surface, whereupon the button protrudes outwardly from the cover and falsely indicates that a trip has occurred. The susceptibility of the button to inappropriately release by such vibration has numerous causes. For instance, the catch surface that is used to retain the button in the depressed condition during operation of the circuit breaker is positioned relatively closely to the cover such that even minor vibrations experienced by the cover can cause the button to disengage the catch surface and falsely indicate a tripped condition. Additionally, the catch surface resists motion of the button only with respect to a single direction, and vibrations transmitted from the cover to the button can cause movement of the button perpendicular to this direction, thus increasing the likelihood of the button becoming disengaged from the catch surface. Still further, the retention of the button on the catch surface is dependent upon the button engaging a camming surface formed on a lid that encloses the button mechanism, and any looseness of the lid with respect to the base upon which the lid sits increases the likelihood of a false trip indication and of difficulty in engaging the button with the catch surface since the button cannot properly engage the camming surface on the lid. Still further, the latch that is operated by the tripping mechanism to disengage the button from the catch surface is subject to inappropriate rotation in the presence of certain shock loading, thus further increasing the likelihood of false trip indications It is thus desired to provide an improved indicator apparatus for a circuit breaker having a greater resistance to shock loading and having more consistent operation.

SUMMARY OF THE INVENTION

In view of the foregoing, an indicator apparatus for a circuit breaker includes an indication mechanism and a latch mechanism mounted on a base, the base being mounted within the circuit breaker. The indication mechanism includes an indicator movably mounted on the base and being translatable along a longitudinal axis between a retracted position and an extended position, with the indicator in the extended position providing an indication visible from the exterior of the circuit breaker of a tripped condition of the circuit breaker. The latch mechanism includes a latch that is moveable between a blocking position and a release position, with the latch in the blocking position being engageable with a ledge on the indicator to retain the indicator in the retracted position. The indicator is biased to the extended position by a first biasing device, and the latch is biased to the blocking position by a second biasing device.

An objective of the present invention is thus to provide an indicator apparatus for a circuit breaker that is relatively resistant to shock loading and vibration.

Another objective of the present invention is to provide an indicator apparatus for a circuit breaker that has a reduced potential for falsely indicating that the circuit breaker is in a tripped condition.

Another objective of the present invention is to provide an indicator apparatus for a circuit breaker that can be reliably manually reset.

Another objective of the present invention is to provide an indicator apparatus for a circuit breaker in which a latch is engageable with an indicator to retain the indicator in a retracted position, the latch being selectively pivotable to release the indicator and to provide an indication visible from the exterior of the circuit breaker of a tripped condition, and in which the latch is statically balanced about is pivot axis.

Another objective of the present invention is to provide a circuit breaker that includes an indication mechanism for providing an indication visible from the exterior of the circuit breaker of a tripped condition of the circuit breaker.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENT

Figure 1:
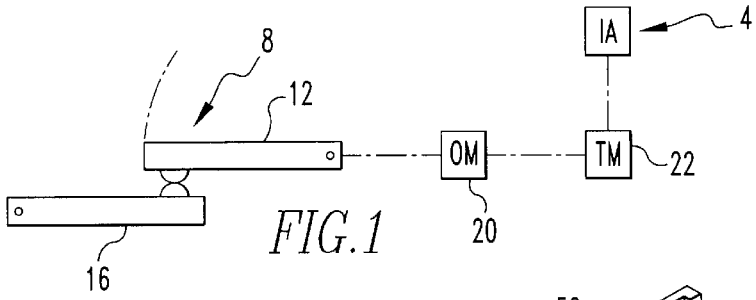
FIG. 1 is a schematic view of a circuit breaker that incorporates an indicator apparatus in accordance with the present invention.
Figure 2:
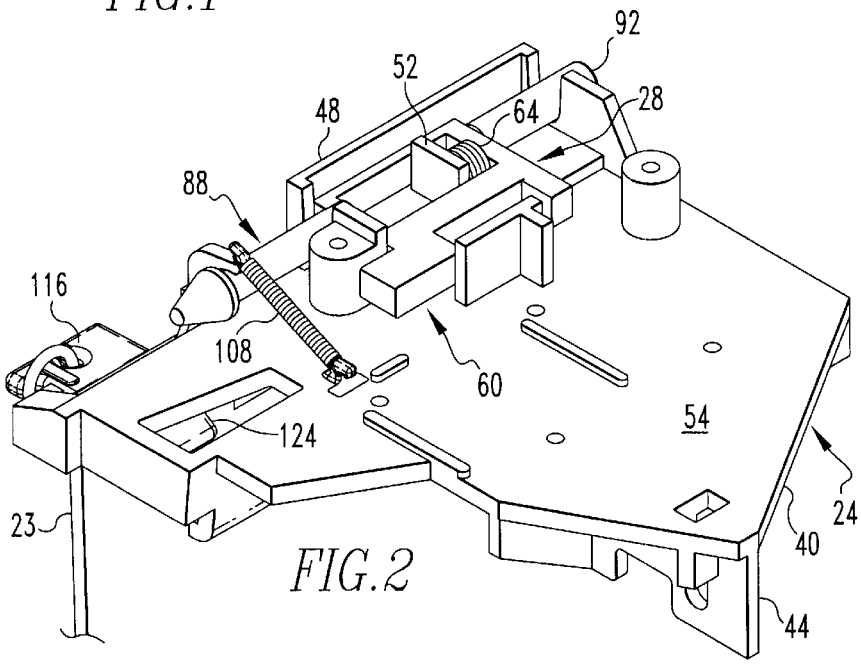
FIG. 2 is an isometric view of the indicator apparatus depicting the indication mechanism in a retracted position.
Figure 3:
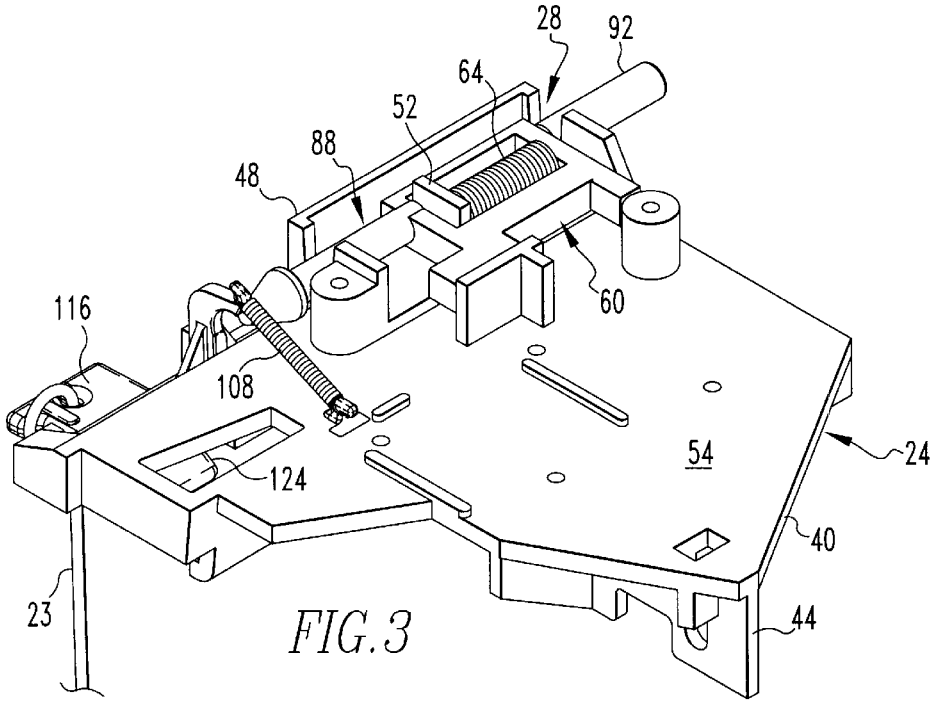
FIG. 3 is a view similar to FIG. 2, except depicting the indication mechanism in an extended position.

An indicator apparatus 4 in accordance with the present invention is indicated generally in FIGS. 1–12. The indicator apparatus 4 is employed in a circuit breaker 8 (FIG. 1) to provide an indication that is visible from the exterior of the circuit breaker 8 regarding whether or not the circuit breaker 8 is in a tripped condition.

The circuit breaker 8 is a typical type of circuit breaker that includes a first conductor 12 in the form of a moveable contact and a second conductor 16 in the form of a stationary contact, with an operating mechanism 20 operatively connected with the first conductor 12, and a tripping mechanism 22 operatively connected with the operating mechanism 20. As is known in the relevant art, the operating mechanism 20 includes a mechanism that selectively moves the first conductor 12 into and out of electrically conductive engagement with the second conductor 16 to switch the first and second conductors 12 and 16 between a closed position and an open position. The tripping mechanism 22 senses the current and/or voltage of the electricity passing through the circuit breaker 8 and triggers the operating mechanism 20 to separate the first and second conductors 12 and 16 from one another during specified overcurrent and under-voltage conditions, as well as other conditions including but not limited to ground fault and/or arc fault conditions. The indicator apparatus 4 is operatively connected with the tripping mechanism 22 via an actuation link 23 to provide a visual indication that the circuit breaker 8 is in the tripped condition in a fashion that will be set forth more fully below.

Figure 4:
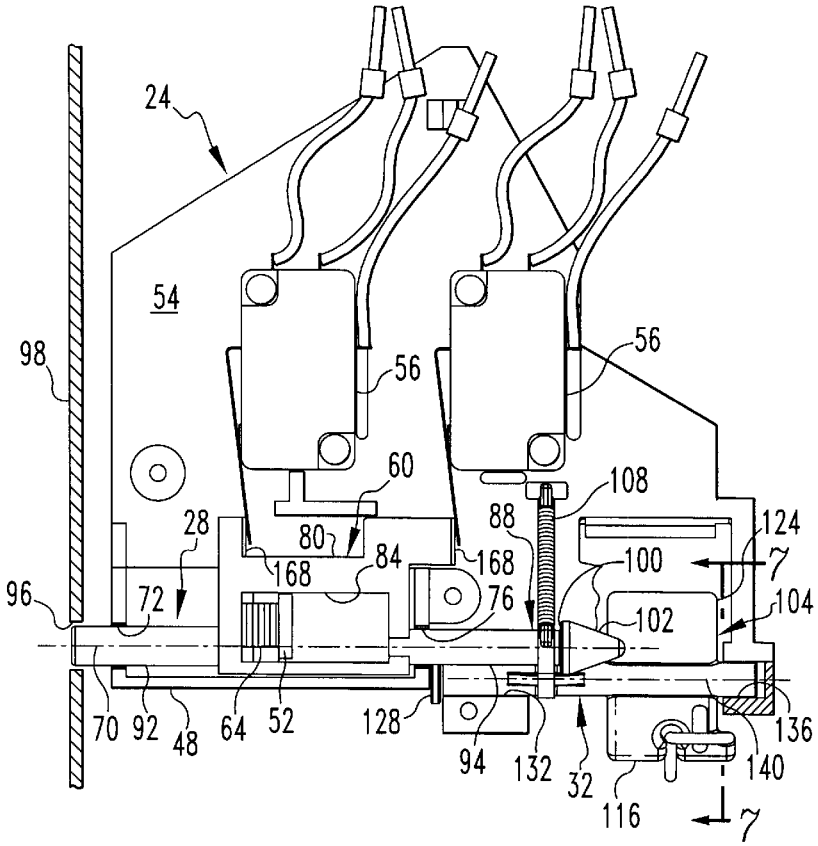
FIG. 4 is a top plan view, partially broken away, of the indicator apparatus with the indication mechanism in the retracted position.
Figure 5:
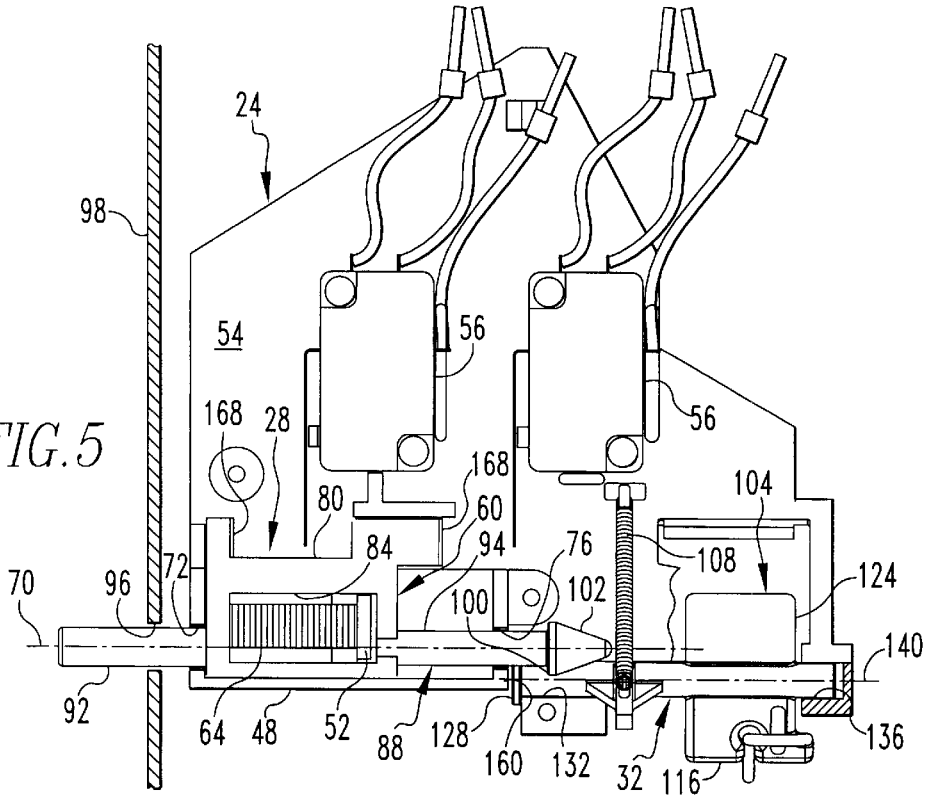
FIG. 5 is a view similar to view 4, except depicting the indication mechanism in the extended position.
Figure 6:
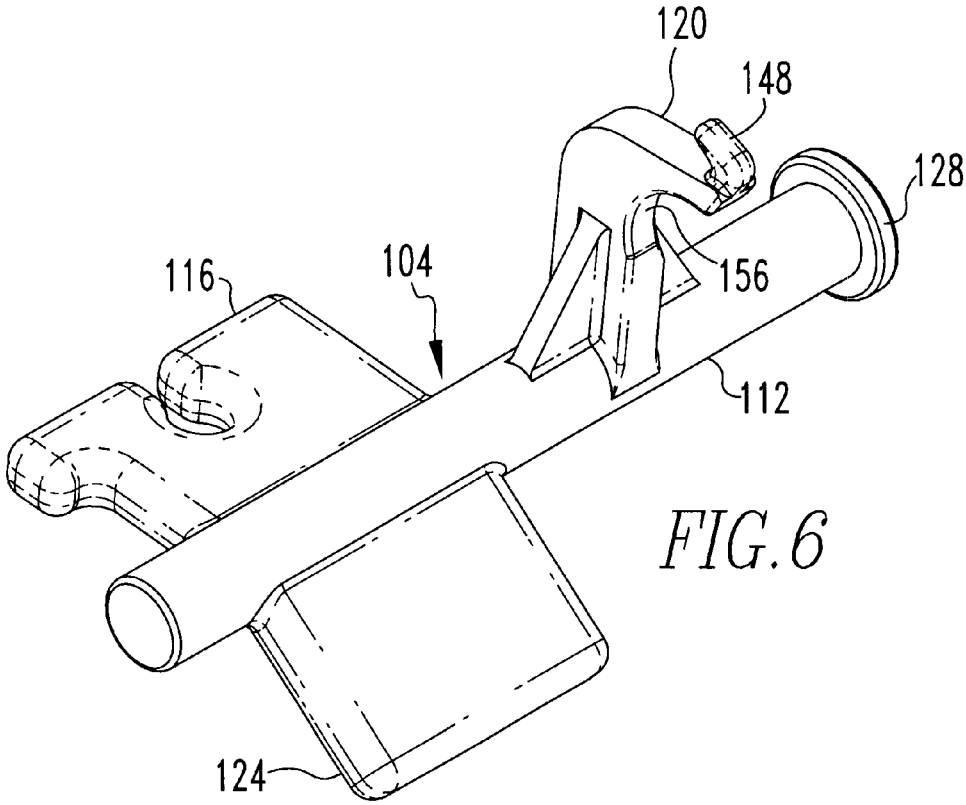
FIG. 6 is an isometric view of a latch of the indicator apparatus.

As is best shown in FIGS. 4 and 5, the indicator apparatus 4 includes a base 24, with an indication mechanism 28 and a latch mechanism 32 being mounted on the base 24. The base 24 includes a generally planar plate 40, with a mounting tab 44 extending outwardly from a first surface 42 (FIGS. 7 and 8) of the plate 40, and a retention wall 48 and a spring tab 52 extending outwardly from an opposite second surface 54 of the plate 40. One or more microswitches 56 can be mounted on the second surface 54 of the plate 40 in order to provide an indication at a remote location that the circuit breaker 8 is in a tripped condition, as will be set forth more fully below. It will be understood that the specific configuration of the base 24 depicted herein is intended to permit the indicator apparatus 4 to be incorporated into certain known circuit breakers, and it will thus be appreciated that the base 24 can be of other configurations without departing from the concept of the present invention.

Figure 9:
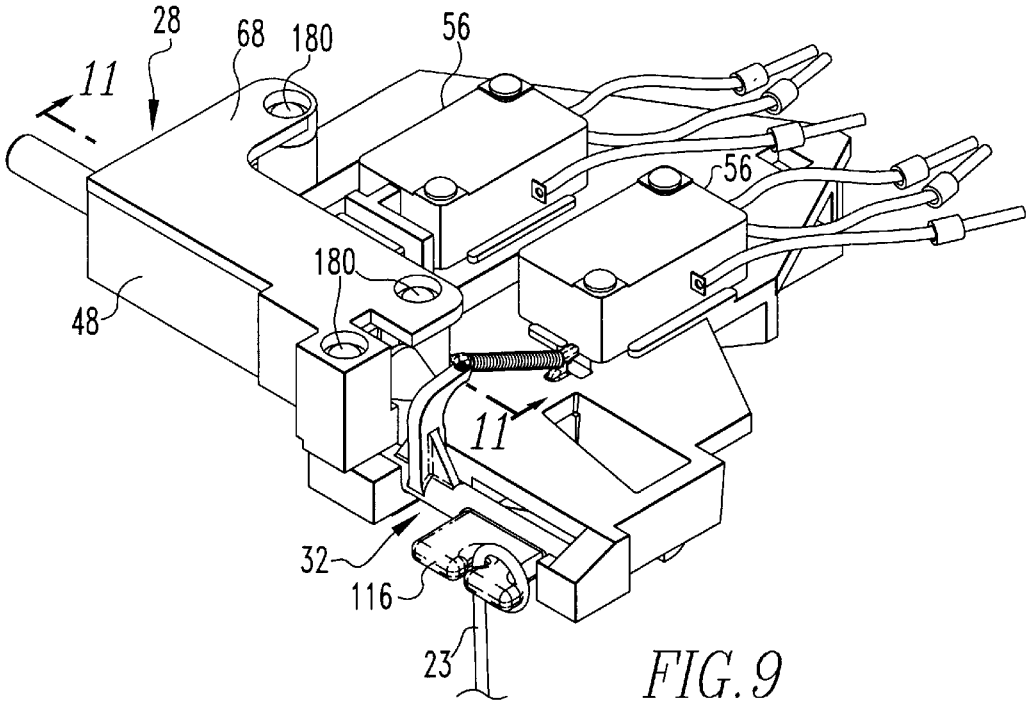
FIG. 9 is an isometric view of the indicator apparatus including a lid of the indication mechanism.
Figure 11:
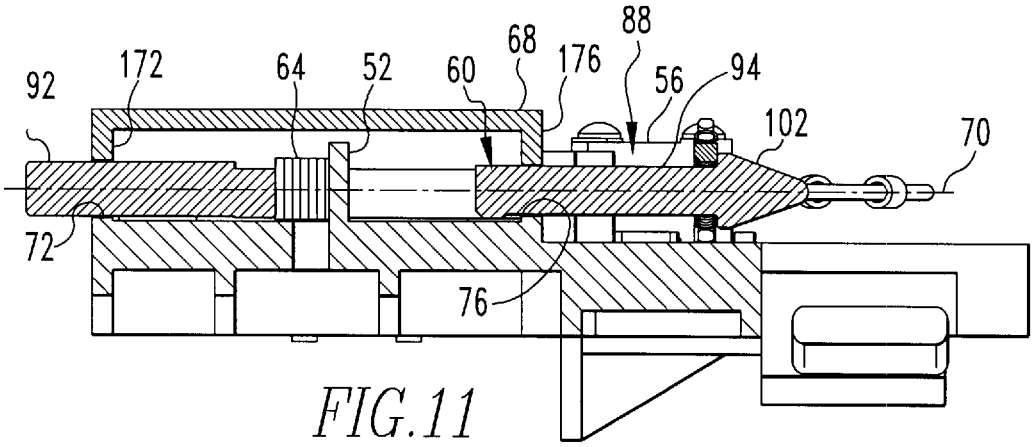
FIG. 11 is a sectional view as taken along line 11—11 of FIG. 9.

As is best shown in FIGS. 4 and 5, the indication mechanism 28 includes an indicator 60, a first spring 64, and a lid 68 (FIGS. 9 and 11). The indicator 60 is slidably translatable along a longitudinal axis 70 between a retracted position (FIG. 4) and an extended position (FIG. 5). The indicator 60 is slidably disposed in a first translational seat 72 and a second translational seat 76 formed in the retention wall 48 of the base 24. The first and second translational seats 72 and 76 are advantageously spaced apart from one another such that small movements of the indicator 60 within the first and second translational seats 72 and 76 result in at most only minimal rotation of the indicator 60 about other axes perpendicular to the longitudinal axis 70.

The indicator 60 includes a frame 80 formed with a substantially rectangular opening 84 therein, and further includes a bar 88 and a button 92 extending outwardly in opposite directions from the frame 80. It can be seen that the first spring 64 is disposed between the springs tab 52 of the base 24 and the opening 84 in the frame 80, and is configured to bias the indicator 60 to the extended position. While the first spring 64 is depicted as being a compression coil spring, it is understood that the first spring 64 serves as a biasing device, and other biasing devices, such as tension springs, torsional springs, and other such devices may be employed without departing from the concept of the present invention.

The button 92 is a substantially cylindrical member that is slidably disposed in the first translational seat 72 and extends through a hole 96 formed in a cover 98 of the circuit breaker 8. The bar 88 is slidably disposed in the second translational seat 76. It can be seen from FIG. 4 that when the indicator 60 is in the retracted position, the free end of the button 92 opposite the frame 80 is approximately flush with the outer surface of the cover 98. It can also be seen from FIG. 5 that when the indicator 60 is in the extended position the free end of the button 92 protrudes outwardly from the cover 98 in such a fashion to be visible from the exterior of the circuit breaker 8.

The bar 88 includes a substantially cylindrical shank 94 extending outwardly from the frame 80, with an annular ledge 100 extending perpendicularly outward from the shank 94 and a ramp 102 tapering radially inward from the radially outermost edge of the ledge 100. For functional reasons it is preferred that the shank 94 and the button 92 be substantially axially aligned with one another, although in other configurations, it may be desirable for the button 92 and shank 94 to be non-axially aligned. While the ramp 102 is depicted herein as being substantially of a conic shape, it will be appreciated from the following that the ramp 102 can be of other configurations, such as one or more inclined surfaces, without departing from the concept of the present invention.

The latch mechanism 32 includes a latch 104 (best shown in FIG. 6) and a second spring 108. The latch mechanism 32 is engageable with the indicator 60 to retain the indicator 60 in the retracted position, as will be set forth more fully below.

The latch 104 includes a substantially cylindrical shaft 112, with an actuation tab 116, a retention finger 120, and a stop tab 124 extending outwardly from the arcuate outer surface of the shaft 112. The shaft 112 additionally includes an annular flange 128 extending outwardly therefrom at one end of the shaft 112. As is best shown in FIGS. 4–5 and FIGS. 7–8, the shaft 112 is pivotably mounted in a first rotational seat 132 and a second rotational seat 136 that are spaced apart from one another, with the latch 104 thus being pivotable about a pivot axis 140 between a blocking position (FIGS. 4 and 7) and a release position (FIGS. 5 and 8). It can be seen that the pivot axis 140 is substantially parallel with the longitudinal axis 70.

As is best shown in FIGS. 7–10, and 12, the second spring 108 extends between a first spring mount 148 at the end of the retention finger 120 opposite the shaft 112 and a second spring mount 152 on the plate 40. It can further be seen that second spring 108 operates as a second biasing device to bias the latch 104 to the blocking position. While the second spring 108 is depicted as a tension coil spring, other types of biasing devices may be employed without departing from the concept of the present invention. As is best shown in FIGS. 6–10, the retention finger 120 extends outward from the shaft 112 and curves thereafter to form an arcuate surface 156 (FIGS. 6 and 8) that is configured to slide across the ramp 102 and engage against the shank 94 adjacent the ledge 100 when the indicator 60 is in the retracted position and when the latch 104 is in the blocking position.

As is best shown in FIGS. 7–10, the retention finger 120 extends in a direction generally away from the second surface 54 of the plate 40 and extends around approximately one-half of the circumference of the shank 94, with the second spring 108 additionally providing a retention force on the first spring mount 148 of the retention finger 120 in a direction toward the second surface 54 of the plate 40. It can additionally be understood from FIGS. 7 and 8 that the biasing of the latch 104 by the second spring 108 to the blocking position engages the arcuate surface 156 of the retention finger 120 with the shank 94 which, in turn, engages the shank 94 against the second translational seat 76. As such, when the indicator 60 is in the retracted position and the latch 104 is in the blocking position, the second spring 108 engages the shank 94 against the second translational seat 76 and thus resists the shank 94 from moving away from the second translational seat 76 in a direction parallel with the second spring 108. Moreover, inasmuch as the retention finger 120 extends around approximately one-half of the circumference of the shank 94, it can be seen that the combined retention of the shank 94 by the retention finger 120 and the second translational seat 76 resists the shank 94 from moving in substantially any direction perpendicular to the longitudinal axis 70.

Figure 10:
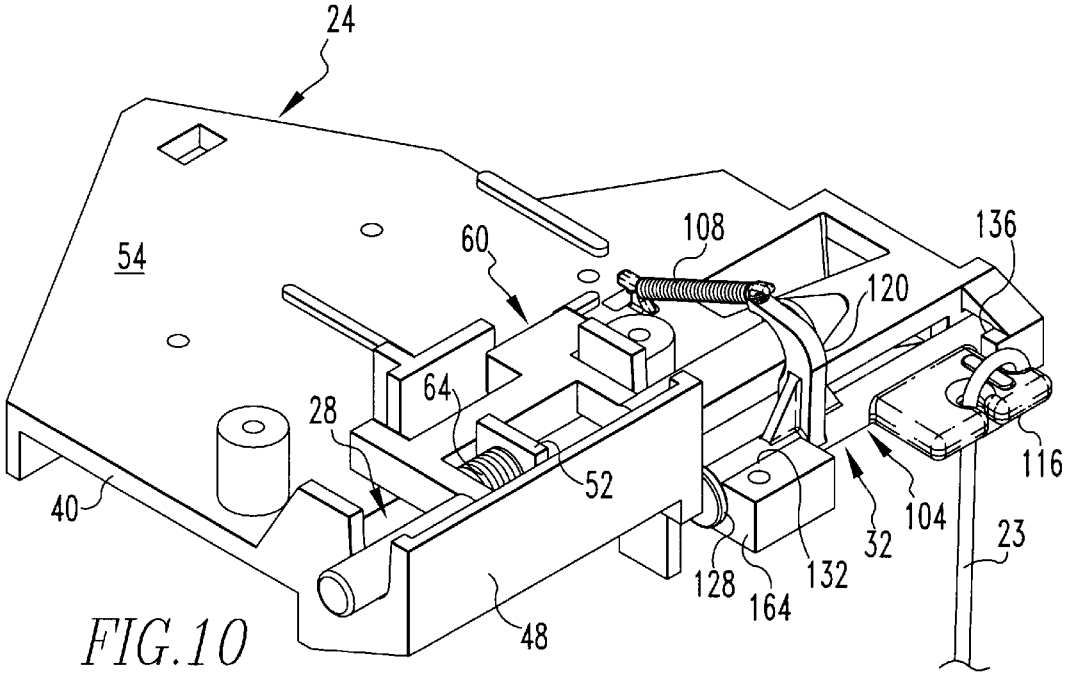
FIG. 10 is an isometric view of a portion of the indicator apparatus.
Figure 12:
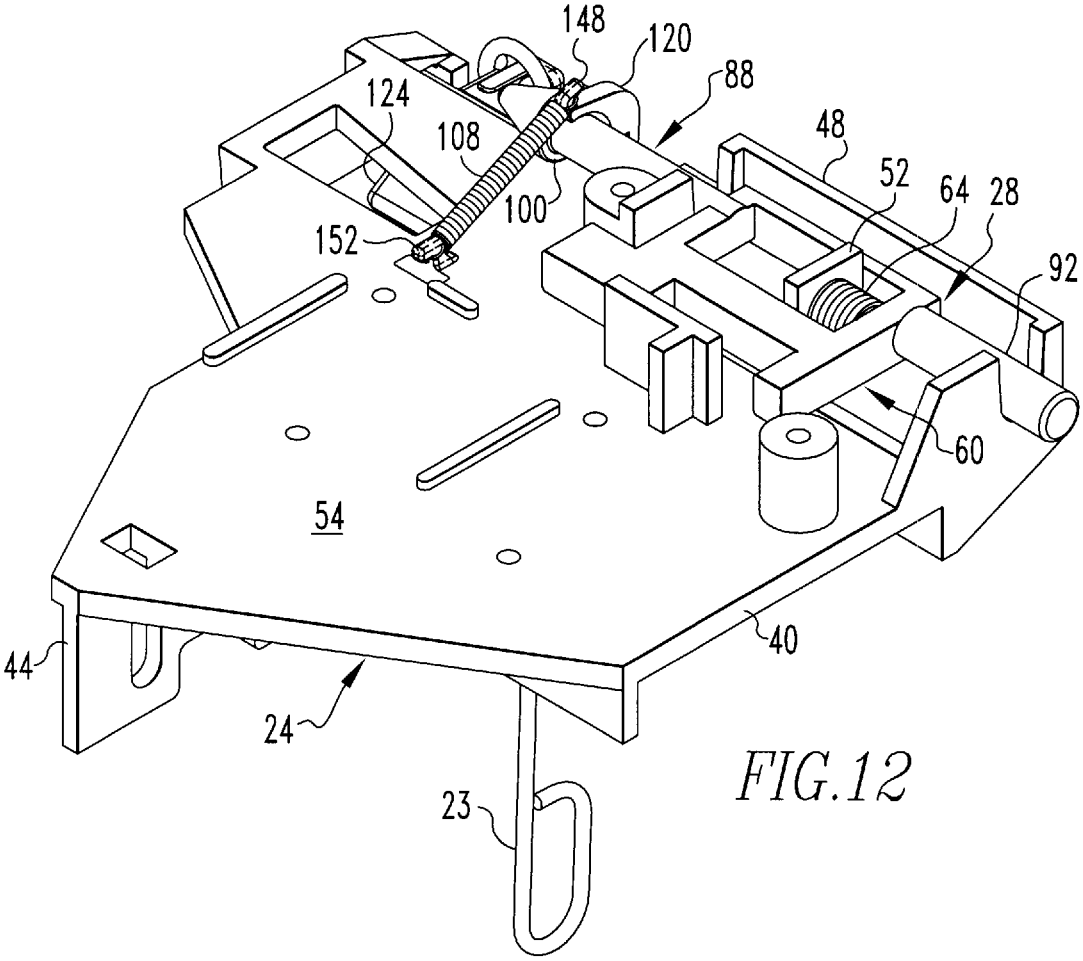
FIG. 12 is an isometric view of a portion of the indicator apparatus.

It can additionally be seen from FIGS. 10–12 that when the indicator 60 is in the retracted position and the latch 104 is in the blocking position, the biasing of the indicator 60 by the first spring 64 to the extended position engages the ledge 100 against the retention finger 120. The engagement of the retention finger 120 against the ledge 100 advantageously retains the indicator 60 in the retracted position. In this regard, the aforementioned engagement of the arcuate surface 156 of the retention finger 120 with the shank 94 that advantageously resists the shank 94 from movement perpendicular to the longitudinal axis 70 additionally advantageously retains the retention finger 120 in the blocking position and against the ledge 100 to resist inappropriate disengagement of the retention finger 120 from the ledge 100. As such, the combined engagement by the latch mechanism 32 of both the shank 94 and the ledge 100 securely retains the indicator 60 in the retracted position and thus advantageously resists the indicator 60 from unintentionally moving to the extended position.

As is best shown in FIGS. 4 and 5, the first and second rotational seats 132 and 136 are spaced from one another such that minor movements of the shaft 112 within the first and second rotational seats 132 and 136 results in at most only minor pivoting of the latch 104 about axes perpendicular to the pivot axis 140. Moreover, it can be seen from FIG. 4 that when the retention finger 120 is engaged against the ledge 100, the biasing of the indicator 60 by the first spring 64 toward the extended position transmits a resultant force in the same direction to the latch 104. As such, an abutment 160 (FIG. 5) is formed on the plate 40 against which the end of the shaft 112 engages to resist the latch 104 from moving with the indicator 60 more than a nominal distance toward the extended position. Additionally, the flange 128 is engageable against a face 164 (FIG. 10) of the plate 40 adjacent the first rotational seat 132 to restrain the shaft 112 from movement in an opposite direction.

In operation, when the circuit breaker 8 is in an untripped condition (whether on or off) the indicator apparatus is in the condition shown generally in FIG. 4, meaning that the indicator 60 is in the retracted position and the latch 104 is in the blocking position with the retention finger 120 engaged against both the shank 94 and the ledge 100. When the circuit breaker 8 becomes tripped, however, the tripping mechanism 122 via the actuation link 23 pivots the latch 104 from the blocking position to the release position (FIG. 8) whereby the retention finger 120 pivots out of engagement with the ledge 100. In such condition, the retention finger 120 no longer retains the indicator 60 in the retracted position, and the first spring 64 thus moves the indicator 60 from the retracted position to the extended position. In such position (FIG. 5), the free end of the button 92 protrudes outwardly from the cover 98 to provide a visual indication from the exterior of the circuit breaker 8 that the circuit breaker 8 is in a tripped condition.

It can also be seen from FIGS. 4 and 5 that the microswitches 56 each include a spring lever that engages an engagement surface 168 on the indicator 60 when the indicator is in the retracted position. At such time, the remote devices that are electrically connected with the microswitches 56, such as bell alarms, warning lights, and the like, are in an off condition. When the indicator 60 moves to the extended position in the event of a tripped condition, however, the engagement surfaces 168 move out of engagement with the spring levers of the microswitches, which operate electrical contacts within the switches to activate the remote alarm devices. As such, the microswitches 56 permit a remote indication of the tripped condition to be made in addition to the visual indication provided by the button 92 protruding from the cover 98 that is visible from the exterior of the circuit breaker 8.

Figure 7:
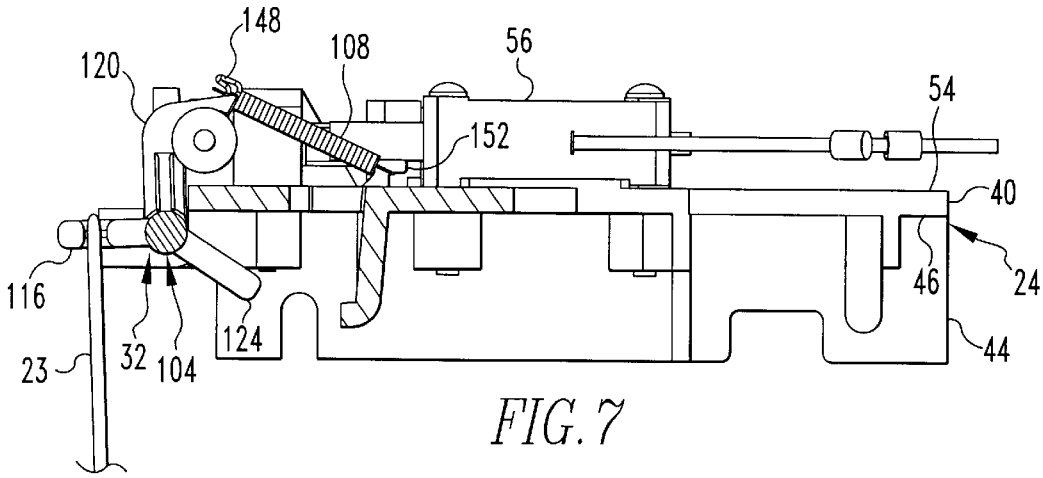
FIG. 7 is a sectional view as taken along line 7—7 of FIG. 4.
Figure 8:
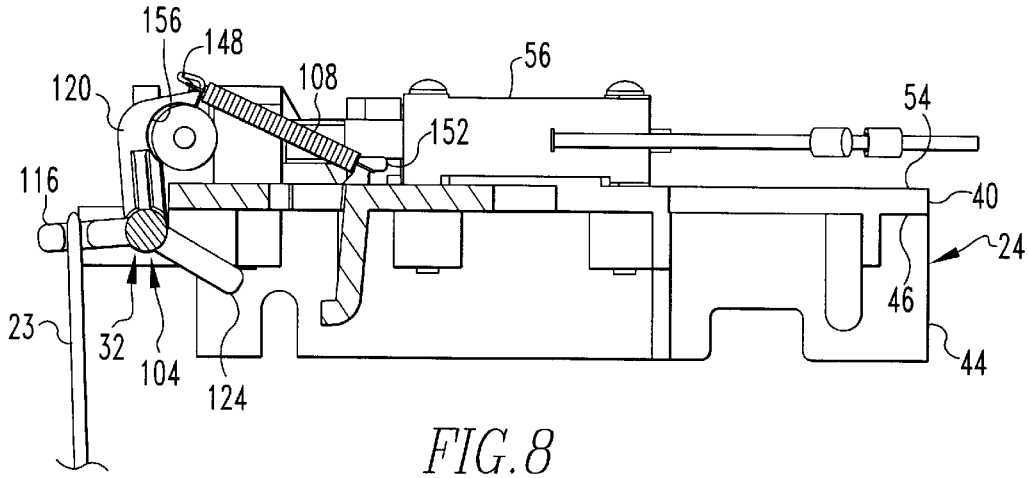
FIG. 8 is a view similar to FIG. 7 except depicting the latch in a release position.

In the embodiment of the indicator apparatus 4 as is depicted in FIGS. 7 and 8, the tripping mechanism 22 pivots the latch 104 from the blocking position to the release position by applying a tensile force to the actuation link 23 which is mounted on the actuation tab 116 of the latch 104. The tensile force results in translation of the actuation link 23, and when transmitted to the latch 104 through the actuation tab 116, such movement results in pivoting of the latch 104 in a counter-clockwise direction with respect to FIGS. 7 and 8. In order to prevent over-pivoting of the latch 104, the stop tab 124 is provided to engage the first surface 46 of the plate 40 to resist further pivoting of the latch 104.

The stop tab 124 is also advantageously configured to statically balance the latch 104 with respect to the pivot axis 140. In this regard, it can be seen from FIGS. 7 and 8 that the actuation tab 116, retention finger 120, and stop tab 124 extend outwardly from the shaft 112 from roughly equally-spaced circumferential positions, and further are correspondingly sized to cause the center of gravity of the latch 104 to coincide with the pivot axis 140. Such static balancing of the latch 104 advantageously resists unwanted pivoting of the shaft 112 in response to certain types of shock loading and vibration of the circuit breaker 8.

Once the condition that caused the circuit breaker 8 to trip is removed and the first and second conductors 12 and 16 are once again engaged with one another, the indicator apparatus 4 can be reset by manually depressing the free end of the button 92 to move the indicator 60 from the extended position to the retracted position. During such movement, the ramp 102 engages the arcuate surface 156 of the retention finger 120, thereby pivoting the latch 104 in a counterclockwise direction with respect to FIGS. 7 and 8. Once the indicator 60 has been translated toward the retracted position sufficiently that the retention finger 120 clears the ledge 100, the second spring 108 returns the latch 104 to the blocking position by pivoting the latch 104 in a clockwise direction with respect to claims 7 and 8. In such position, the combined biasing of the first and second springs 64 and 108 engages the retention finger 120 against both the shank 94 and the ledge 100.

As is best shown in FIG. 11, the lid 68 includes a first tab 172 and a second tab 176 that are received in the first and second translational seats 72 and 76, respectively, and are positioned to permit very little movement by the indicator 60 other than in a direction along the longitudinal axis 70. Moreover, as is best shown in FIG. 9, the lid 68 is securely retained on the base 24 with three screws 180, with two of the screws 180 being disposed on opposite sides of the shank 94 in the vicinity of the ledge 100. The lid 68 and the screws themselves thus provide an additional level of retention of the indicator 60 in the first and second translational seats 72 and 76.

As can best be seen in FIGS. 4 and 5, the button 92 is disposed in the hole 96 formed in the cover 98 whether the indicator 60 is in the retracted position (FIG. 4) or in the extended position (FIG. 5). It is particularly noted, however, that when the circuit breaker 8 is subjected to vibration or shock loading, and in the event that such vibration or shock loading is transmitted to the cover 98, the vibration or shock loading may be correspondingly transmitted through the hole 96 to the button 92. The retention finger 120 and the ledge 100 are, however, advantageously configured to be substantially opposite the free end of the button 92 that is disposed in the hole 96 when the indicator 60 is in the retracted position. As such, the amplitude of any vibration or shock loading transmitted from the cover 98 at the free end of the button 92 is advantageously much lower at the ledge 100 that is retained in its given position by the retention finger 120. Moreover, such vibration or shock loading is at least partially dissipated by the first and second translational seats 72 and 76, and advantageously is of such small magnitude when it reaches the ledge 100 that it can be overcome by the retentive force of the retention finger 120 on the latch. It can further be seen that by applying the force of the second spring 108 directly to the end of the retention finger 120 where the first spring mount 148 is disposed, the retentive force of the second spring 108 is applied substantially directly to the bar 88 without being transmitted through numerous operatively connected mechanisms. Such direct application of retentive force permits the indicator apparatus 4 to be advantageously designed with generous manufacturing tolerances without impairing the reliability of the indicator apparatus to resist false trip indications due to vibration or shock loading to the circuit breaker 8.

The indicator apparatus 4 of the present invention thus provides an indication mechanism 28 that can provide a visual indication of a condition of the circuit breaker 8, such as a tripped condition, yet is securely retained in the retracted position by the latch mechanism 32 to resist inappropriate movement of the indicator 60 during shock loading or vibration experience by the circuit breaker 8. The first and second translational seats 72 and 76 are spaced apart from one another, as are the first and second rotational seats 132 and 136, which minimizes overall movement of the indicator 60 and the latch 104, other than translation of the indicator 60 along the longitudinal axis 70 and rotation of the latch 104 about the pivot axis 140. Moreover, the latch 104 is statically balanced with respect to the pivot axis 140 to resist unintended pivoting of the latch 104 during such shock loading or vibration. Moreover, by positioning the ledge 100 opposite the free end of the button 92 that is disposed in the hole 96 of the cover 98, the effect of any vibration or shock loading transmitted from the cover 98 to the indicator 60 is substantially alleviated by the first and second translational seats 72 and 76 and by the distance of the free end of the button 92 from the ledge 100, which thus resists such vibration or shock loading from disengaging the retention finger 120 from the ledge 100.

While a particular embodiment of the present invention has been described herein, it is understood that various changes, additions, modification, and adaptations may be made without departing from the scope of the present invention, as set forth in the following claims.

What is claimed is:

1. An indicator apparatus for a circuit breaker, the indicator apparatus comprising:

a base;

an indication mechanism, the indication mechanism including an indicator movably mounted on the base, the indicator including an elongated bar and a ledge, the ledge extending outwardly from the bar, the indicator being translatable along a longitudinal axis between a retracted position and an extended position, the indicator being biased to the extended position by a first biasing device, the indicator in the extended position providing an indication visible from the exterior of the circuit breaker of a condition of the circuit breaker; and a latch mechanism including a latch and a second biasing device, the latch being movable between a blocking position and a release position, the latch being biased to the blocking position by the second biasing device, the latch in the blocking position being engageable with the ledge to retain the indicator in the retracted position.

2. The indicator apparatus as set forth in claim 1, in which the indicator is mounted in a first translational seat and a second translational seat, and in which the first and second translational seats are spaced from one another.

3. The indicator apparatus as set forth in claim 2, in which the latch engaged with the ledge additionally engages the bar against the first translational seat to restrain the indicator from movement along at least a first direction transverse to the longitudinal axis.

4. The indicator apparatus as set forth in claim 1, in which the latch is pivotable about a pivot axis between the blocking and release positions.

5. The indicator apparatus as set forth in claim 4, in which the pivot axis is substantially parallel with the longitudinal axis.

6. The indicator apparatus as set forth in claim 4, in which the latch includes a retention finger extending from a shaft, the shaft being mounted in a first rotational seat and a second rotational seat, the first and second rotational seats being disposed on the base and spaced from one another.

7. The indicator apparatus as set forth in claim 6, in which the latch further includes an actuation tab and a stop tab extending from the shaft, the retention finger, actuation tab, and stop tab being substantially statically balanced with one another with respect to the pivot axis.

8. The indicator apparatus as set forth in claim 6, in which the retention finger extends at least partially around the bar when the latch is engaged with the ledge.

9. The indicator apparatus as set forth in claim 8, in which the second biasing device extends between the base and the end of the retention finger opposite the shaft.

10. The indicator apparatus as set forth in claim 4, in which the indicator includes a ramp opposite the ledge, the ramp being structured to engage and pivot the latch about the pivot axis when the indicator is moved from the extended position to the retracted position.

11. The indicator apparatus as set forth in claim 2, in which the indicator includes a frame and a button, the button and the bar extending from the frame, a free end of the button extending at least partially through a hole formed in a cover of the circuit breaker, and in which the ledge is formed on the bar substantially opposite the free end of the button.

12. A circuit breaker comprising:

a first conductor;

a second conductor;

a tripping mechanism operatively connected with one of the first and second conductors to selectively connect and disconnect the first and second conductors to and from one another; and an indicator apparatus operatively connected with the tripping mechanism;

the indicator apparatus including a base, an indication mechanism, and a latch mechanism;

the indication mechanism including an indicator movably mounted on the base, the indicator including an elongated bar and a ledge, the ledge extending outwardly from the bar, the indicator being translatable along a longitudinal axis between a retracted position and an extended position, the indicator being biased to the extended position by a first biasing device, the indicator in the extended position providing an indication visible from the exterior of the circuit breaker of a condition of the circuit breaker; and the latch mechanism including a latch and a second biasing device, the latch being movable between a blocking position and a release position, the latch being biased to the blocking position by the second biasing device, the latch in the blocking position being engageable with the ledge to retain the indicator in the retracted position.

13. The circuit breaker as set forth in claim 12, in which the indicator is mounted in a first translational seat and a second translational seat, the first and second translational seats being spaced from one another, and in which the latch engaged with the ledge additionally engages the bar against the first translational seat to restrain the indicator from movement along at least a first direction transverse to the longitudinal axis.

14. The circuit breaker as set forth in claim 12, in which the latch is pivotable about a pivot axis between the blocking and release positions.

15. The circuit breaker as set forth in claim 14, in which the pivot axis is substantially parallel with the longitudinal axis.

16. The circuit breaker as set forth in claim 14, in which the latch includes a retention finger extending from a shaft, the shaft being mounted in a first rotational seat and a second rotational seat, the first and second rotational seats being disposed on the base and spaced from one another.

17. The circuit breaker as set forth in claim 16, in which the retention finger extends at least partially around the bar when the latch is engaged with the ledge.

18. The circuit breaker as set forth in claim 17, in which the second biasing device extends between the base and the end of the retention finger opposite the shaft.

19. The circuit breaker as set forth in claim 14, in which the indicator includes a ramp opposite the ledge, the ramp being structured to engage and pivot the latch about the pivot axis when the indicator is moved from the extended position to the retracted position.

20. The circuit breaker as set forth in claim 12, in which the indicator includes a frame and a button, the button and the bar extending from the frame, a free end of the button extending at least partially through a hole formed in a cover of the circuit breaker, and in which the ledge is formed on the bar substantially opposite the free end of the button.

* * * * *